US008187014B2

(12) United States Patent
Laughlin

(10) Patent No.: US 8,187,014 B2
(45) Date of Patent: May 29, 2012

(54) LANYARD CONNECTOR

(75) Inventor: Patrick John Laughlin, Thousand Oaks, CA (US)

(73) Assignee: Cooper Technologies Company, Houston, TX (US)

( * ) Notice: Subject to any disclaimer, the term of this patent is extended or adjusted under 35 U.S.C. 154(b) by 572 days.

(21) Appl. No.: 12/468,406

(22) Filed: May 19, 2009

(65) Prior Publication Data

US 2010/0294117 A1 Nov. 25, 2010

(51) Int. Cl.
*H01R 13/73* (2006.01)

(52) U.S. Cl. ..... 439/258; 439/180; 439/254

(58) Field of Classification Search ..... 439/180, 439/253, 254, 258
See application file for complete search history.

(56) References Cited

U.S. PATENT DOCUMENTS

| | | | | |
|---|---|---|---|---|
| 3,509,515 | A | 4/1970 | Acord | |
| 3,609,632 | A * | 9/1971 | Vetter | 439/258 |
| 3,953,098 | A | 4/1976 | Avery et al. | |
| 4,421,373 | A * | 12/1983 | Ratchford et al. | 439/271 |
| 4,433,889 | A * | 2/1984 | Ratchford et al. | 439/272 |
| 4,447,103 | A * | 5/1984 | Werth et al. | 439/271 |
| 4,605,271 | A * | 8/1986 | Burns | 439/160 |
| 5,017,150 | A * | 5/1991 | Moody | 439/197 |
| 6,872,889 | B1 * | 3/2005 | Cruttenden et al. | 174/69 |
| 8,052,444 | B1 * | 11/2011 | McMahon et al. | 439/258 |
| 2010/0015833 | A1 * | 1/2010 | Laughlin et al. | 439/271 |
| 2010/0230572 | A1 * | 9/2010 | Laughlin | 248/328 |
| 2010/0294117 | A1 * | 11/2010 | Laughlin | 89/1.58 |

FOREIGN PATENT DOCUMENTS

| | | |
|---|---|---|
| EP | 0369872 A2 | 5/1990 |
| GB | 2165402 A | 4/1986 |

OTHER PUBLICATIONS

European Search Report, Dated Sep. 23, 2010, for related application EP10163344.4, 8 pages.

* cited by examiner

*Primary Examiner* — James Harvey
(74) *Attorney, Agent, or Firm* — King & Spalding LLP

(57) ABSTRACT

Lanyard connectors for release of an ordinance are provided. The lanyard connectors include a coupling sleeve and locking ring movable between a first position and a second position. The lanyard connectors also include a latching spring and a reset spring. The latching spring is partially disposed within a groove in the locking ring in the first position, and removed from the groove in the second position. The reset spring is held in place by a connector cover and interfaces with a second groove in the locking ring. The reset spring is compressed in the second position. The lanyard connectors allow for release of an ordinance receptacle when in the second position. Methods of using the connectors are also provided.

21 Claims, 16 Drawing Sheets

LANYARD CONNECTOR

TECHNICAL FIELD

The present invention relates generally to lanyard connectors. More particularly, the present invention is directed to an umbilical connector for releasing an ordinance from an aircraft.

BACKGROUND OF THE INVENTION

An aircraft carrying an ordinance, such as a weapon, typically utilizes an umbilical connector and a single loop contiguous lanyard for release of the ordinance. The connector interfaces between the ordinance and a lanyard cable, and the lanyard cable is looped around an aircraft mounted post, also known as a "bail bar."

The ordinance mounts to the connector using a receptacle on the ordinance, and the ordinance is held in place by a coupling ring and a number of threaded segments. Conventional lanyard connectors utilize a single primary compression type spring that prevents the coupling ring from shifting and allowing release of the connector. Upon pulling the lanyard cable during aircraft ordinance release, the primary spring compresses. Compression of the primary spring allows the coupling ring to shift such that the threaded segments move outward. However, as the connector begins disconnecting from the ordinance receptacle, the primary spring acts to close the threaded segments and "ratcheting" may occur, whereby the threaded segments become caught on threading or the receptacle as the connector is being pulled free. As a result, the connector may be destroyed, which in turn may damage the umbilical cable, as well as the aircraft airframe. The cost of replacing damaged connectors and cables, as well as repairing damaged airframes is high.

Therefore, a need exists for a lanyard connector that can withstand aircraft ordinance release, without easily being damaged.

SUMMARY OF THE INVENTION

The present invention attempts to satisfy the above-described need by providing a connector capable of withstanding the forces associated with repeated ordinance release. The connectors generally include a coupling sleeve coupled to a locking ring. The coupling sleeve and the locking ring are movable between a first position and a second position. The connectors also include a latching spring and a reset spring. In certain aspects, the latching spring is a canted coil type spring and the reset spring is a sinusoidal type spring or a compression type spring. The reset spring is held in place by a connector cover. The locking ring includes at least two grooves. The latching spring is partially disposed within the first groove in the first position, and removed from the first groove in the second position. A portion of the reset spring rests within the second groove of the locking ring. When the coupling sleeve and the locking ring are in the second position, the reset spring is at least partially compressed between the second groove and the connector cover.

In some aspects of the invention, the connectors include a plug housing having a groove. The latching spring is partially disposed within the plug housing groove in the first position, and fully compressed within the plug housing groove in the second position. In certain aspects, the connectors include a lanyard ring configured to couple to a lanyard cable. The lanyard ring is coupled to the coupling ring and movable between the first position and the second position.

In some aspects of the invention, the connectors include a plurality of threaded segments in communication with the coupling sleeve. In certain aspects, six threaded segments are included. Adjacent threaded segments are partially separated to one another in the first position, and are more separated in the second position. The threaded segments engage an ordinance receptacle in the first position, and allow release of the ordinance receptacle in the second position.

Methods of the present invention include releasing an ordinance receptacle from a connector of the present invention by shifting the coupling ring and locking ring to the second position, and releasing the ordinance receptacle. The latching spring is removed from the first groove in the locking ring and fully compressed within the plug housing in the second position. The reset spring is also compressed in the second position. The threaded segments move radially outward and allow release of the ordinance receptacle.

These and other aspects, objects, features, and embodiments of the present invention will become apparent to those having ordinary skill in the art upon consideration of the following detailed description of illustrative embodiments exemplifying the best mode for carrying out the invention as presently perceived.

DETAILED DESCRIPTION OF THE INVENTION

Figure 1A:
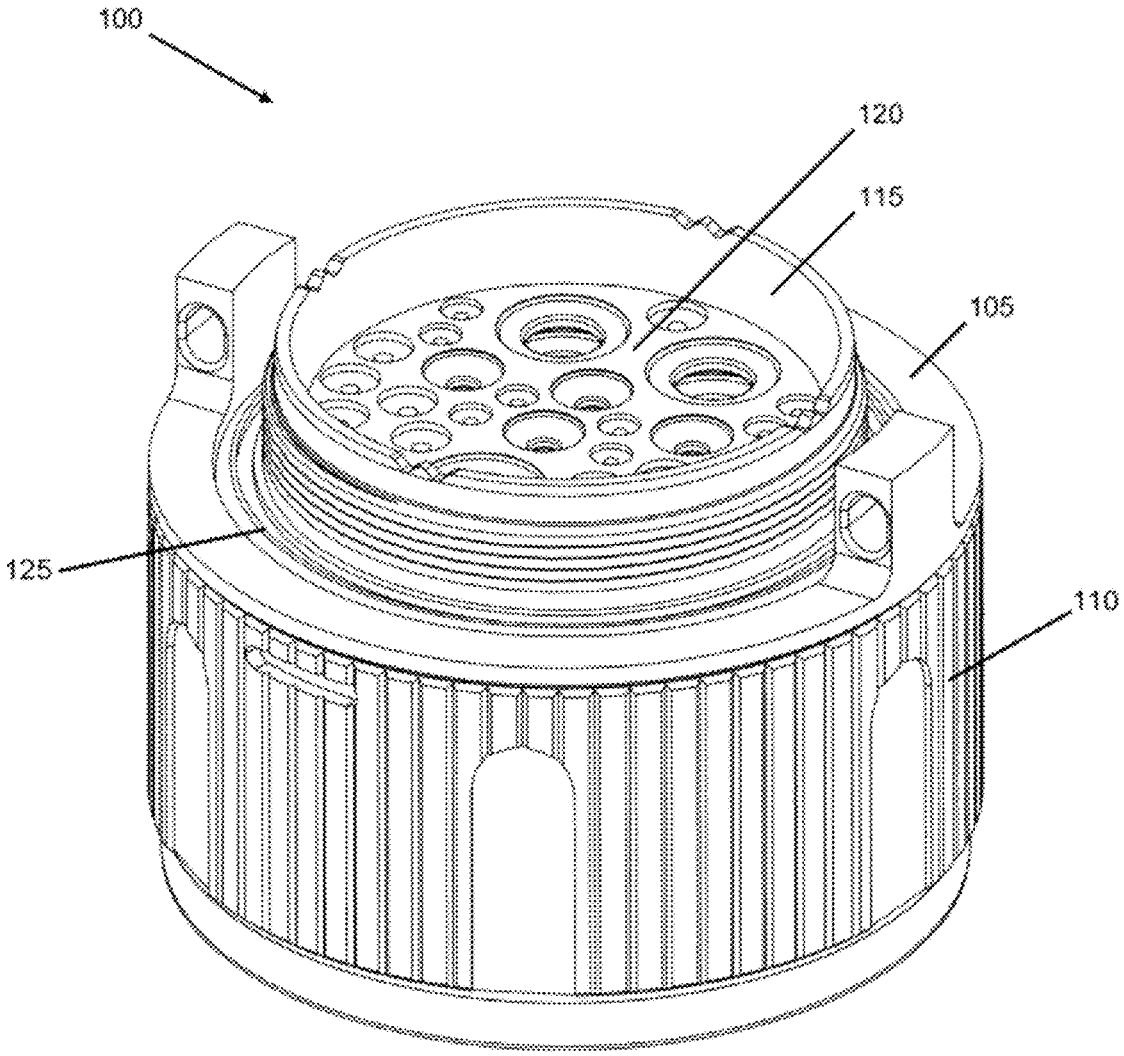
FIG. 1A is a top perspective view of a lanyard connector, according to an exemplary embodiment.

A lanyard connector described herein interfaces between a lanyard cable and an ordinance to be released from an aircraft. The connector is generally capable of handling the forces associated with the release of the ordinance. Generally, the connector has more longevity than existing lanyard connectors in the market.

The invention may be better understood by reading the following description of non-limitative, exemplary embodiments with reference to the attached drawings wherein like parts of each of the figures are identified by the same reference characters.

FIG. 1A is a top perspective view of a lanyard connector 100, showing components visible from an exterior, according to an exemplary embodiment. The connector 100 includes a circular lanyard ring 105 coupled to a cylindrical coupling ring 110 and forming a first cavity. A cylindrical plug housing 115 having a second cavity is positioned in the first cavity. A plug insert assembly 120 is positioned within the second cavity of the plug housing 115. The connector 100 also includes a circular rear connector cover 125 positioned within the first cavity between the lanyard ring 105 and the plug housing 115.

Figure 1B:
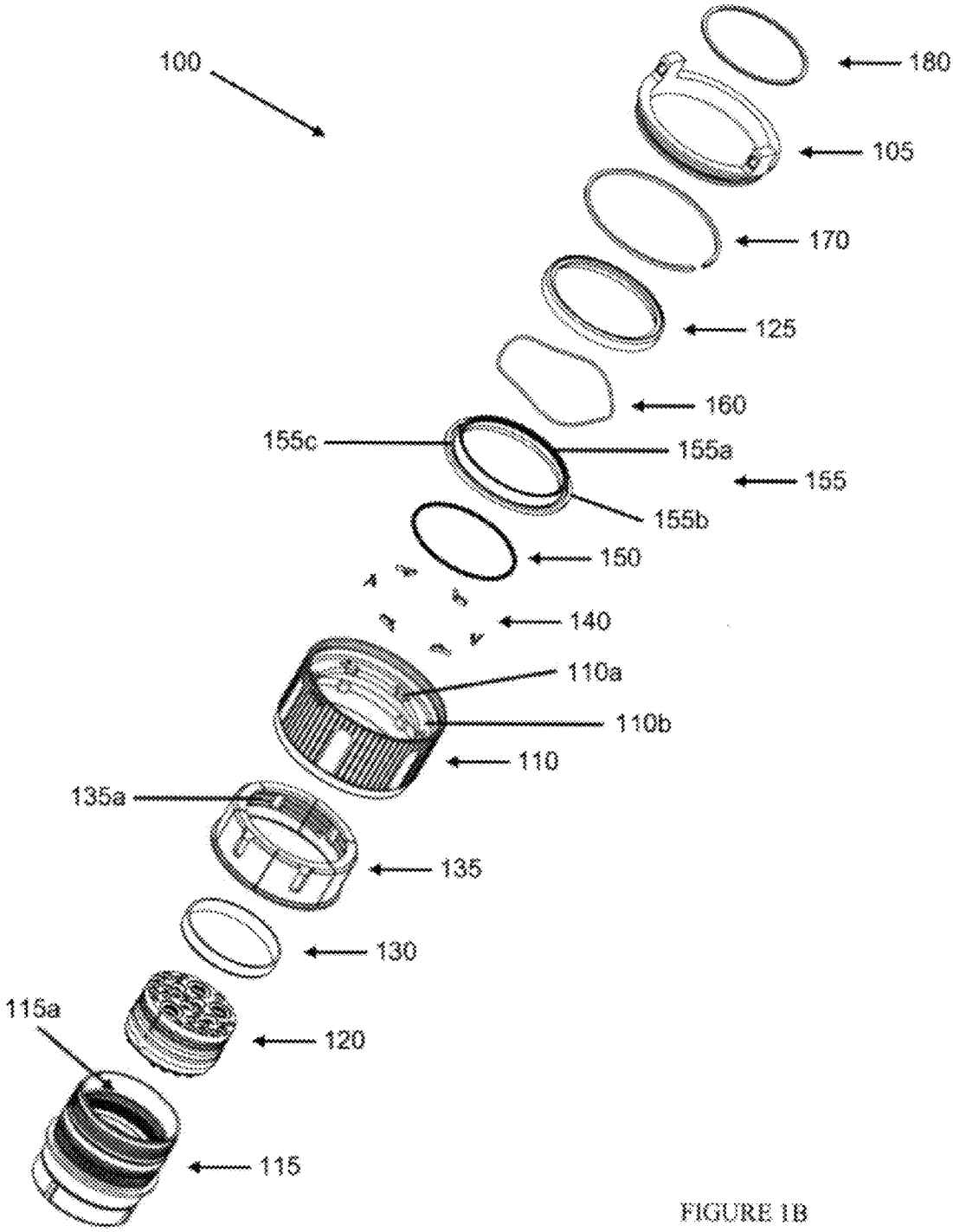
FIG. 1B is an exploded view of the lanyard connector shown in FIG. 1A, according to an exemplary embodiment.
Figure 1C:
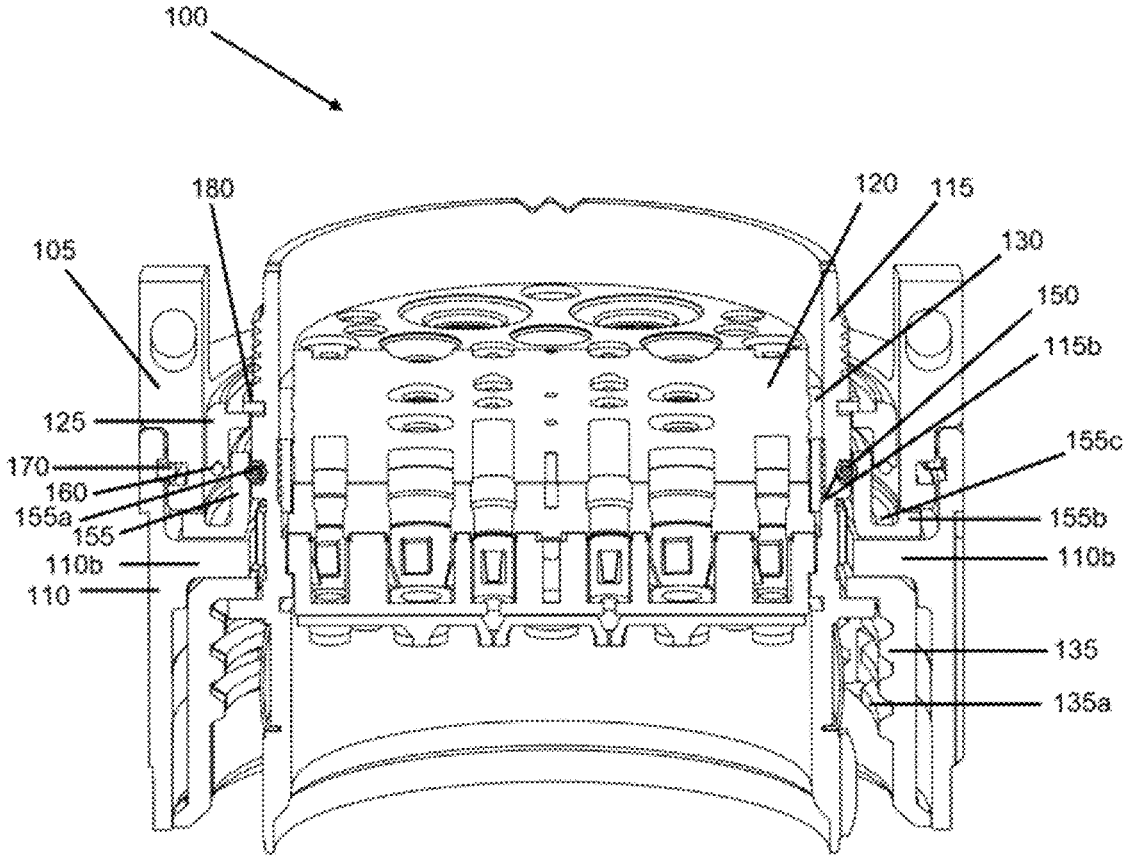
FIG. 1C is a side cross-sectional view of the lanyard connector shown in FIG. 1A, according to an exemplary embodiment.

FIG. 1B is an exploded view showing all of the components of the lanyard connector 100, and FIG. 1C is a side cross-sectional view of the assembled lanyard connector 100, according to an exemplary embodiment. The lanyard connector 100 includes the plug insert assembly 120 positioned within a cavity 115*a* of the plug housing 115. The insert assembly 120 is held in place by an insert retainer 130. The insert retainer 130 is a press-fit plastic ring that can be glued in place. In alternative embodiments, the insert assembly 120 can be held in place by an aluminum-threaded ring. One having ordinary skill in the art will recognize that the insert retainer 130 can be fabricated from any material so long as the insert retainer 130 is able to withstand the forces exposed to the system without detaching the plug insert assembly 120 from the plug housing 115.

The connector 100 includes six threaded segments 135 that surround the plug housing 115 and an ordinance receptacle (not shown) coupled to the plug insert assembly 120. The threaded segments 135 include threads 135*a* for mating with corresponding threads (not shown) on the ordinance receptacle. Upon radial separation of the six threaded segments 135, the threads 135*a* disengage with the corresponding threads on the ordinance receptacle and allow disconnection of the ordinance receptacle from the plug insert assembly 120, thereby releasing the ordinance.

The coupling ring 110 surrounds the plug housing 115 and the threaded segments 135. In certain alternative embodiments, the coupling ring 110 may be replaced with a sleeve (not shown). The connector 100 also includes six anti-rotation springs (or ratchet springs) 140. The ratchet springs 140 are positioned within grooves 110*a* of the coupling ring 110, and interface with an outer surface of the plug housing 115. The ratchet springs 140 prevent the coupling ring 110 from rotating and unthreading itself from an ordinance receptacle (not shown).

The connector 100 includes a circular canted coil latching spring 150. The latching spring 150 is disposed at least partially within a groove 115*b* on the plug housing 115. The latching spring 150 also interfaces with a groove 155*a* on a circular locking ring 155. The locking ring 155 includes a flange 155*b* in contact with the lanyard ring 105 and a protrusion 110*b* extending from the interior of the coupling ring 110.

The connector 100 also includes a reset spring 160 positioned below the rear connector cover 125 and between the lanyard ring 105 and the locking ring 155. At least a portion of the reset spring 160 rests within a groove 115*c* on the locking ring 155. The rear connector cover 125 holds the reset spring 160 in place. In certain embodiments, the reset spring 160 is a sinusoidal spring.

The connector 100 further includes a circular lanyard ring retainer 170. The lanyard ring retainer 170 holds the lanyard ring 105 to the coupling ring 110 and allows the lanyard ring 105 to rotate about the coupling ring 110. In certain alternative embodiments, the lanyard ring retainer 170 is a sinusoidal spring or includes multiple coils that overlap. One having ordinary skill in the art will recognize that a number of lanyard ring retainers exist.

The connector 100 also includes a circular rear cover retainer 180. The rear cover retainer 180 is positioned around the plug housing 115 and above the rear connector cover 125. The rear cover retainer 180 forces the rear connector cover 125 towards the reset spring 160, which ultimately holds the connector 100 together.

Figure 2:
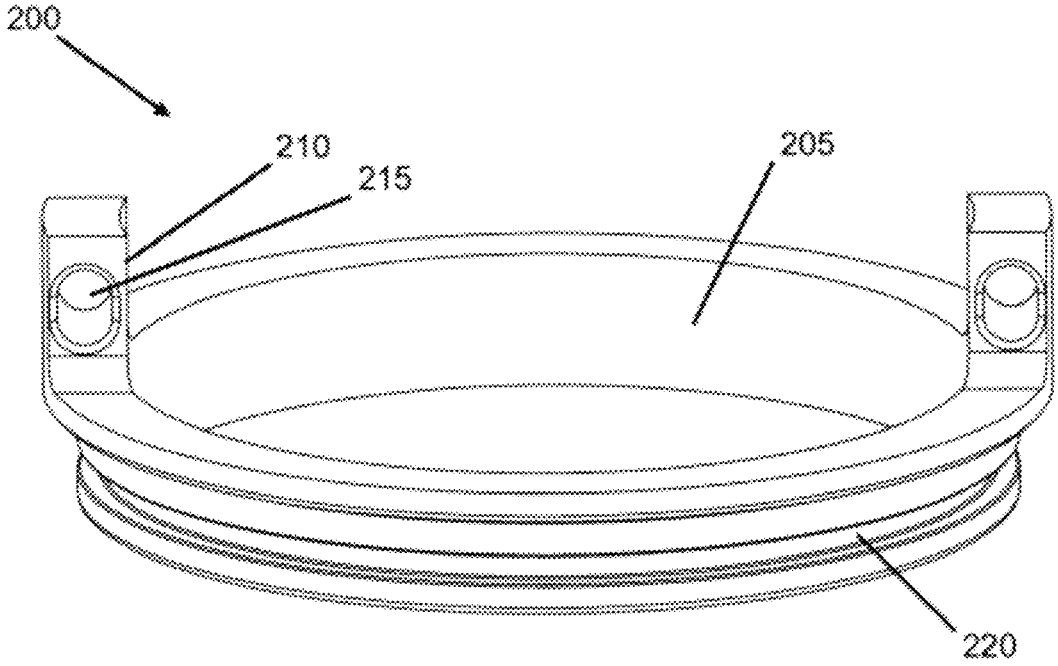
FIG. 2 is a top perspective view of a lanyard ring, according to an exemplary embodiment.

FIG. 2 is a top perspective view of a circular lanyard ring 200, according to an exemplary embodiment. The lanyard ring 200 includes a base 205 from which two protrusions 210 extend orthogonally. The protrusions 210 are positioned opposite from each other. Each protrusion 210 includes an opening 215 configured to receive a means for connecting to a lanyard cable (not shown). The lanyard ring 200 also includes a groove 220 configured to receive a lanyard ring retainer 170 (FIGS. 1B and 1C).

Figure 3:
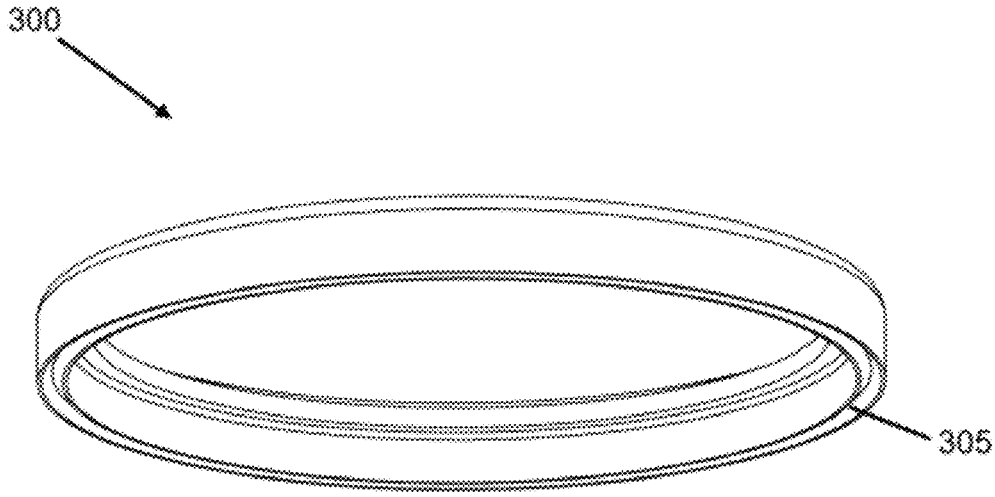
FIG. 3 is a bottom perspective view of a connector cover, according to an exemplary embodiment.
Figure 4:
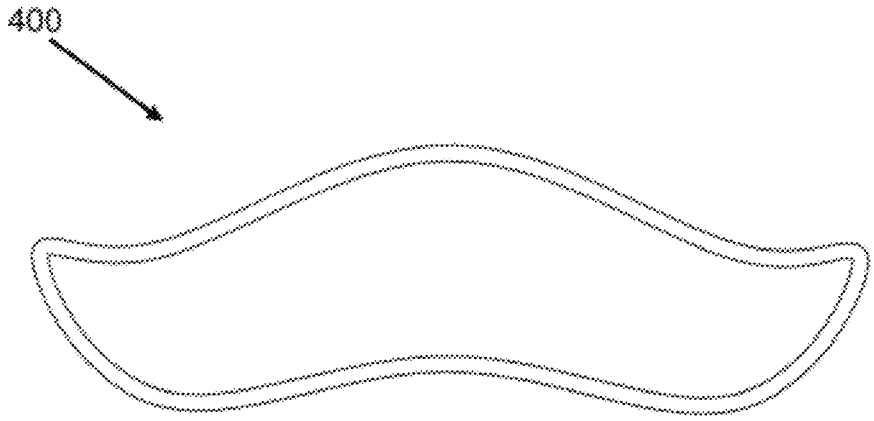
FIG. 4 is a top perspective view of a reset spring, according to an exemplary embodiment.
Figure 5:
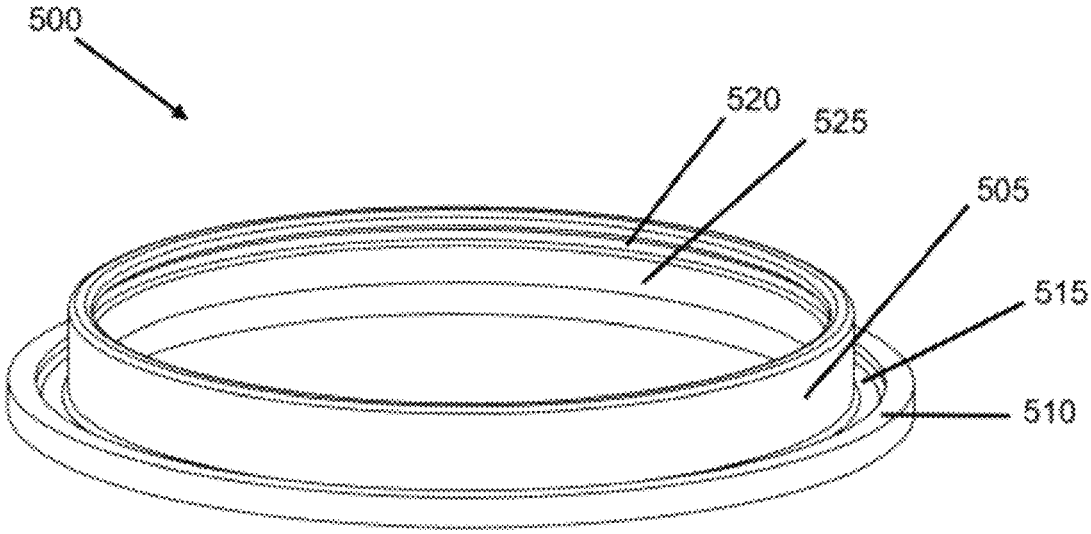
FIG. 5 is a top perspective view of a locking ring, according to an exemplary embodiment.

FIG. 3 is a bottom perspective view of a connector cover 300, according to an exemplary embodiment. The connector cover 300 is circular and includes a groove 305. The groove 305 is configured to at least partially receive a reset spring 400, shown in FIG. 4. The reset spring 400 functions to separate the connector cover 300 (FIG. 3) from a locking ring 500 (FIG. 5). The reset spring 400 may be a compression type spring or a sinusoidal type spring. In certain embodiments, the reset spring 400 is a bumper spring fabricated from a compressible rubber.

Figure 6:
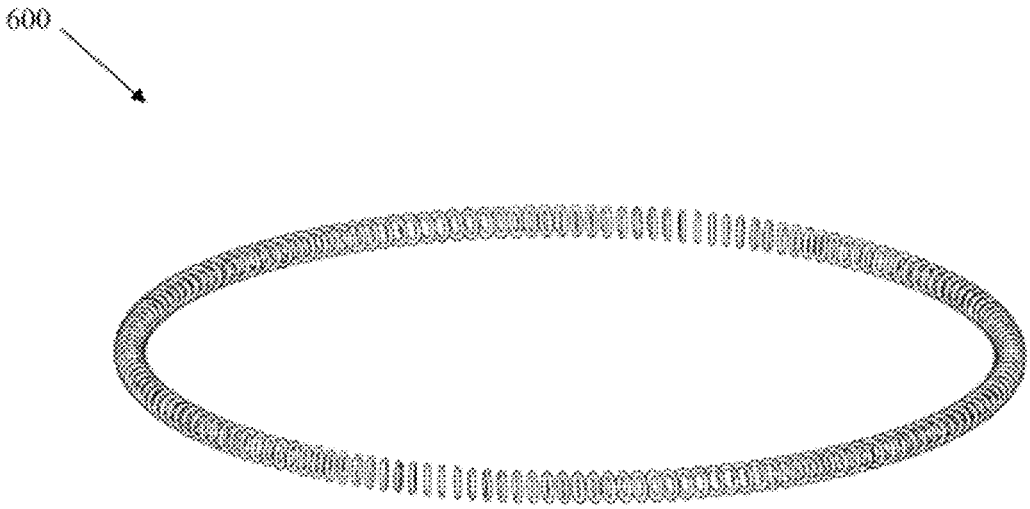
FIG. 6 is a perspective view of a latching spring, according to an exemplary embodiment.

FIG. 5 is a top perspective view of the locking ring 500, according to an exemplary embodiment. The locking ring 500 includes a circular base 505 from which a flange 510 extends. The flange 510 includes a groove 515 configured to receive at least a portion of the reset spring 400 (FIG. 400). The locking ring 500 also includes a polygonal groove 520 adjacent to a generally smooth circular wall 525. The groove 520 is configured to at least partially engage a latching spring 600, shown in FIG. 6. In some embodiments, the latching spring 600 may be a canted coil type spring.

Figure 7:
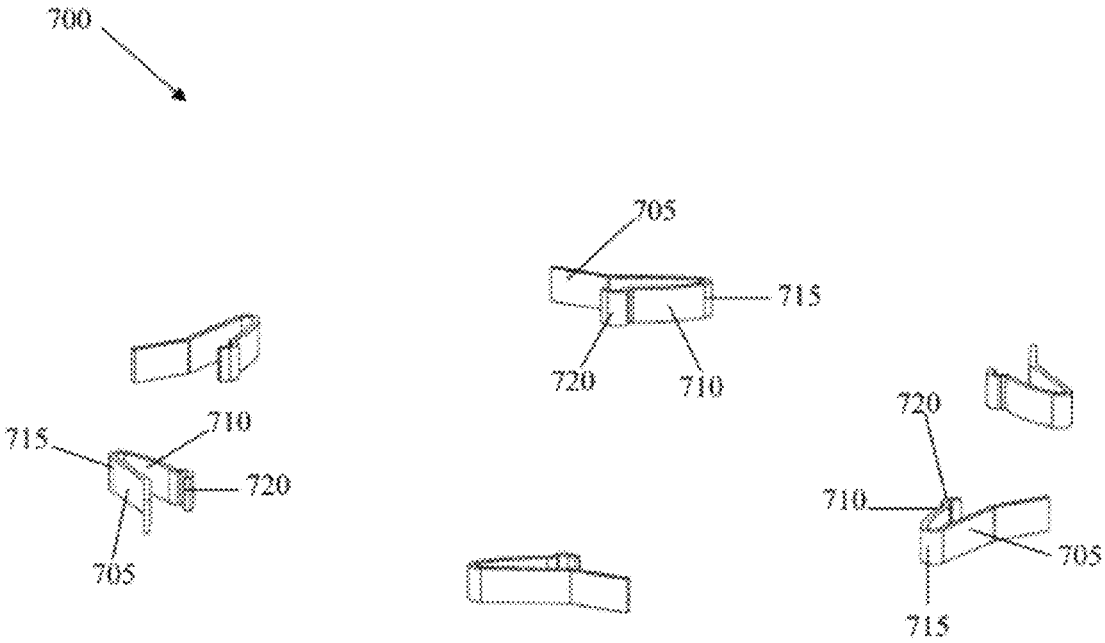
FIG. 7 is a perspective view of anti-rotation springs, according to an exemplary embodiment.

FIG. 7 is a perspective view of six anti-rotation springs 700, according to an exemplary embodiment. Each anti-rotation spring 700 includes a first portion 705 connected to a second portion 710 by a resilient bend 715. The second portion 710 includes a radial bend 720 that engage a portion of a plug housing (not shown). The anti-rotation springs 700 can function to minimize or eliminate unwanted unthreading of a coupling ring 800, described with respect to FIG. 8 below, from an ordinance receptacle (not shown). In certain alternative embodiments, springs and ball bearings, bent flat springs, or a single molded ring having spring arms may be used to prevent rotation of the coupling ring 800. One having ordinary skill in the art will recognize that a number of devices can be used in place of the anti-rotation springs 700 as long as the devices prevent the coupling ring 800 from unthreading from the ordinance receptacle during vibration.

Figure 8:
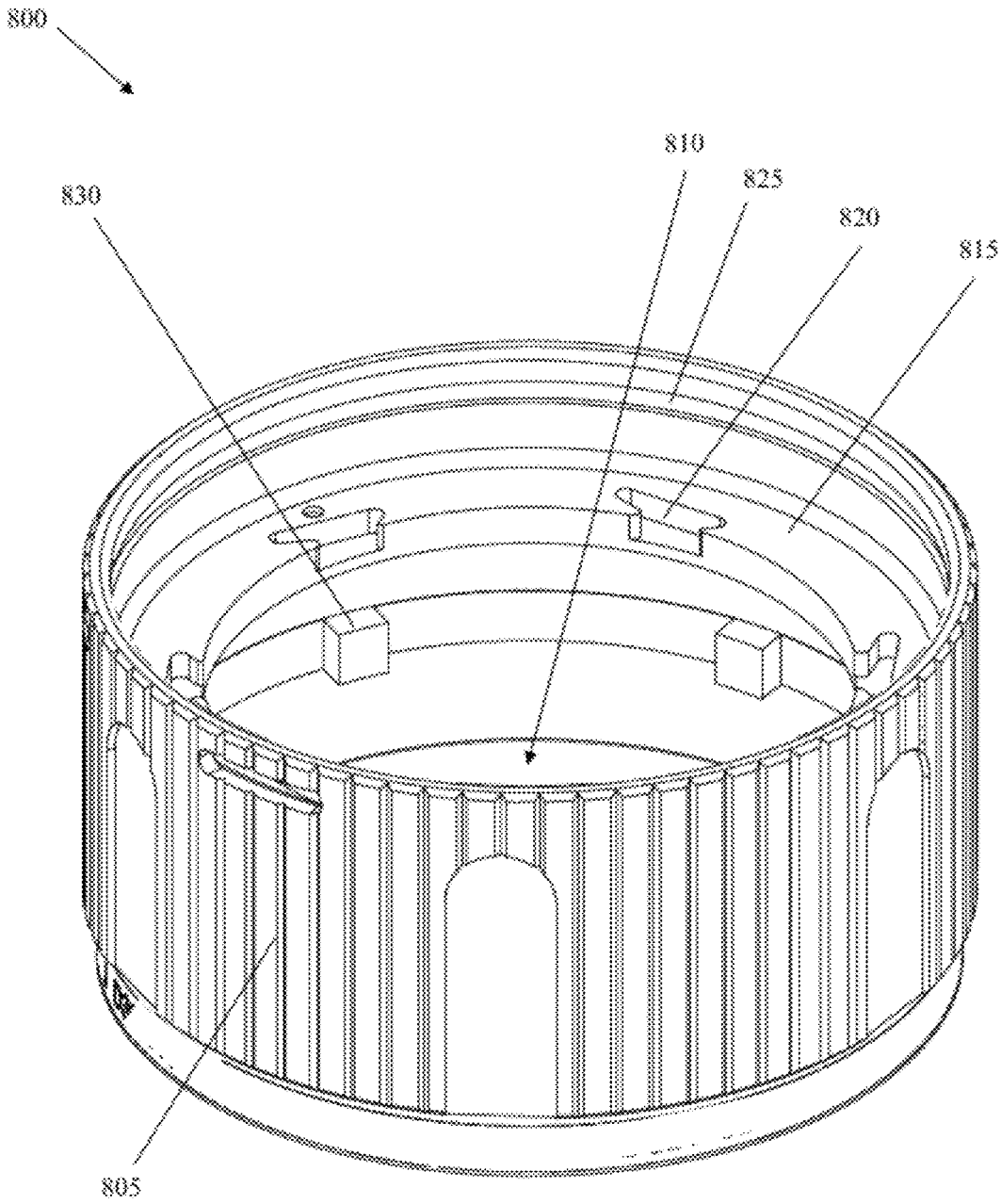
FIG. 8 is a top perspective view of a coupling ring, according to an exemplary embodiment.

FIG. 8 is a top perspective view of the coupling ring 800, according to an exemplary embodiment. The coupling ring 800 includes a cylindrical base wall 805 having a cavity 810 therein. The coupling ring 800 includes a ledge 815 extending orthogonally inward from the base wall 805. The ledge 815 includes six notches 820 spaced equally apart on the protrusion 815. The notches 820 are configured to receive anti-rotation springs 700 (FIG. 7). One having ordinary skill in the art will recognize that any number of notches 820 and corresponding anti-rotation springs 700 may be included in alternative embodiments of the invention. One having ordinary skill in the art will also recognize that the anti-rotation springs 700 may vary in configuration, and notches 820 can be configured to receive the corresponding anti-rotation springs 700.

The coupling ring 800 also includes a groove 825 in the interior of the base wall 805. The groove 825 is configured to at least partially receive the lanyard ring retainer 170 (FIGS. 1B and 1C). The coupling ring 800 further includes six square-shaped protrusions 830 spaced equally apart below the ledge 815 on the interior of the base wall 805. The protrusions 830 engage six threaded segments 900, shown in FIG. 9.

Figure 9:
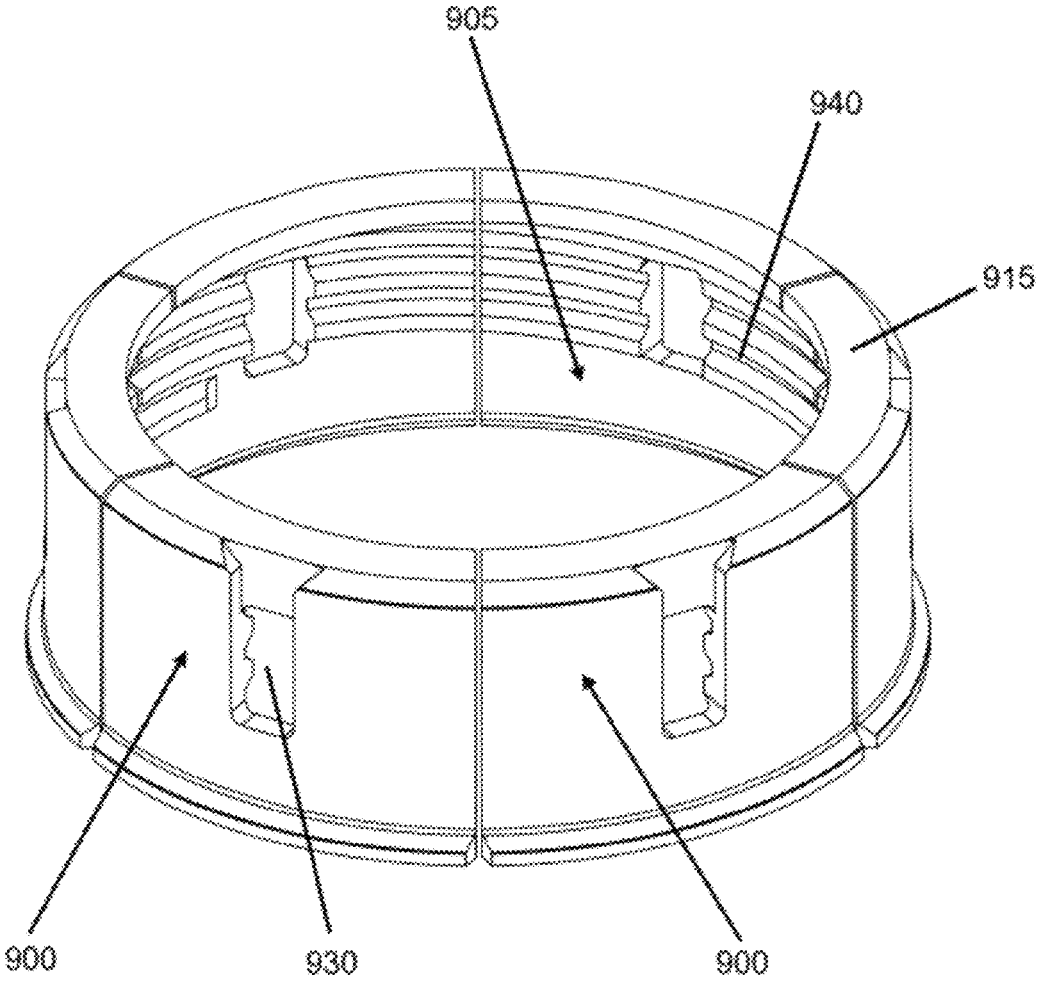
FIG. 9 is a top perspective view of threaded segments, according to an exemplary embodiment.

FIG. 9 is a top perspective view of six separate threaded segments 900, according to an exemplary embodiment. When placed adjacent to one another, the threaded segments 900 form a cylinder having a cavity 905 therein. Each threaded segment 900 includes a vertically-extending rectangular-shaped indentation 930 configured to receive one of the square-shaped protrusions 830 of the coupling ring 800 (FIG. 8). Each threaded segment 900 also includes a ledge 915. When the threaded segments 900 are positioned within the coupling ring 800 and the indentations 930 receive the protrusions 830, the ledge 915 sits flush against the bottom of the ledge 815 of the coupling ring 800 (FIG. 8). Each threaded segment 900 also includes a plurality of threads 940 extending horizontally on a surface opposite the indentation 930. The threads 940 are configured to receive and mate with an ordinance receptacle (not shown). In certain embodiments, the threaded segments 900 are MIL-DTL-38999 compliant threaded segments. One having ordinary skill in the art will recognize that any number of threaded segments 900 may be included in alternative embodiments of the invention.

Figure 10:
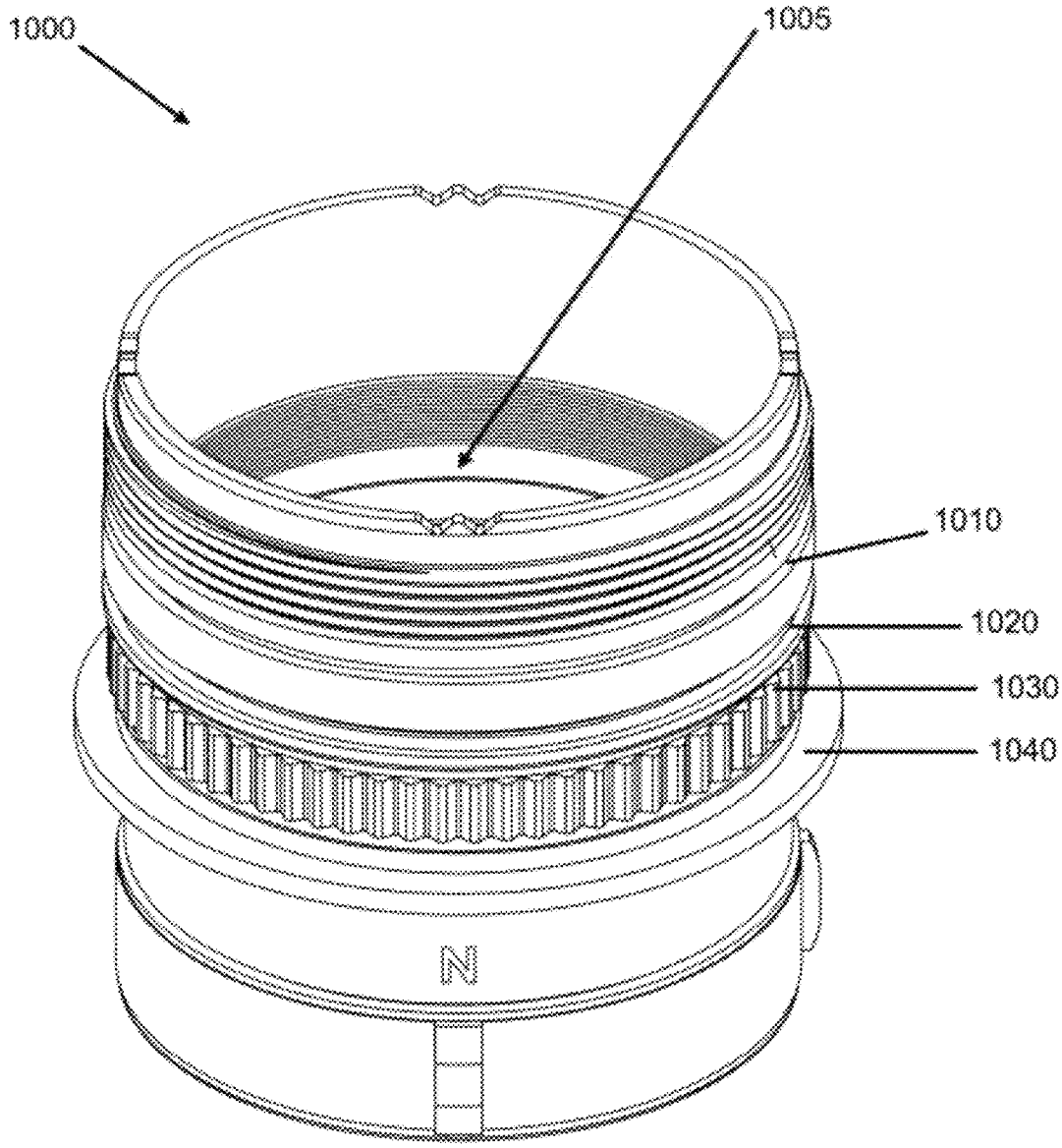
FIG. 10 is a top perspective view of a plug housing, according to an exemplary embodiment.

FIG. 10 is a top perspective view of a plug housing 1000, according to an exemplary embodiment. The plug housing 1000 is cylindrical-shaped and includes a cavity 1005. The plug housing 1000 includes a first groove 1010 configured to receive a portion of the rear cover retainer 180 (FIGS. 1B and 1C) therein. The plug housing 1000 includes a second groove 1020 positioned a distance below the first groove 1010 and configured to receive a portion of the latching spring 600 (FIG. 6) therein. The plug housing 1000 also includes a plurality of teeth 1030 extending vertically about a circumference the plug housing 1000. The teeth 1030 are configured so as to mate with the radial bend 720 of the anti-rotation springs 700 (FIG. 7) and prevent the coupling ring 800 (FIG. 8) from unthreading itself. The plug housing 1000 further includes a ledge 1040 extending orthogonally outward. The ledge 1040 interfaces a bottom of the ledge 915 of each threaded segment 900 (FIG. 900) when assembled.

In certain embodiments, the plug housing 1000 is a MIL-DTL-38999 compliant plug housing. The cavity 1005 of the plug housing 1000 is configured to receive a plug insert assembly 120 (FIGS. 1A-1C) therein. In certain embodiments, the plug insert assembly 120 is a MIL-DTL-38999 compliant insert assembly having 20 contacts and a shell size of 25, although any type or configuration of insert assembly may be used that can fit into the housing. One having ordinary skill in the art will recognize that a number of insert assemblies exist that may be utilized with the present invention.

Figure 11A:
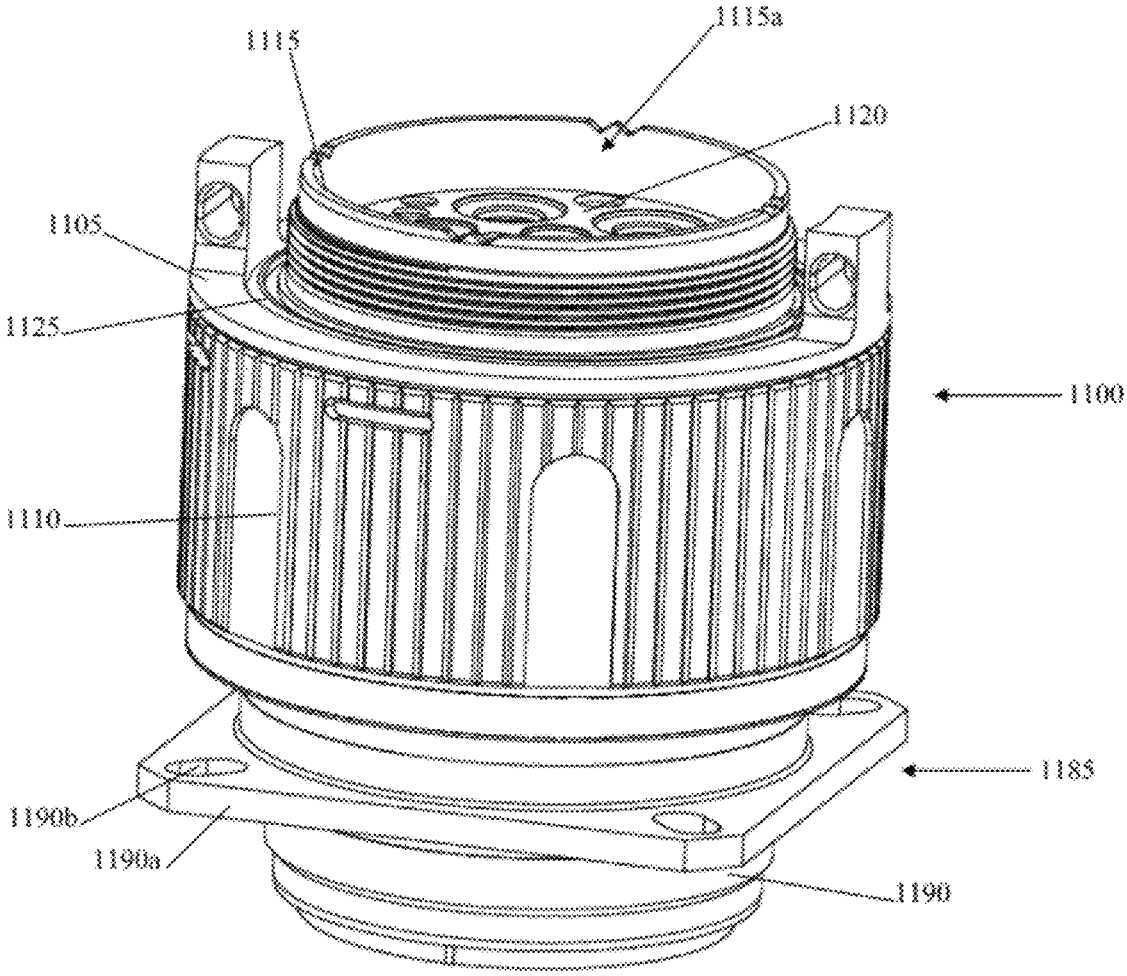
FIG. 11A is a perspective view of a lanyard connector and an ordinance receptacle, in a mated position, according to an exemplary embodiment.

FIG. 11A is a perspective view of a lanyard connector 1100 coupled to an ordinance receptacle 1185, according to an exemplary embodiment. The lanyard connector 1100 includes a circular lanyard ring 1105 coupled to a cylindrical sleeve 1110, and surrounding a cylindrical plug housing 1115. The plug housing 1115 includes a cavity 1115*a* to receive a plug insert assembly 1120 therein. The connector 1100 also includes a circular rear connector cover 1125 positioned between the lanyard ring 1105 and the plug housing 1115.

The ordinance receptacle 1185 includes a receptacle housing 1190 that houses a receptacle insert assembly (not shown). The ordinance receptacle 1185 can include a flange 1190*a* extending from the receptacle housing 1190. The flange 1190*a* includes opening 1190*b* configured to receiving a fastener (not shown) for securing the ordinance receptacle 1185 to a wall or stationary surface (not shown).

Figure 11B:
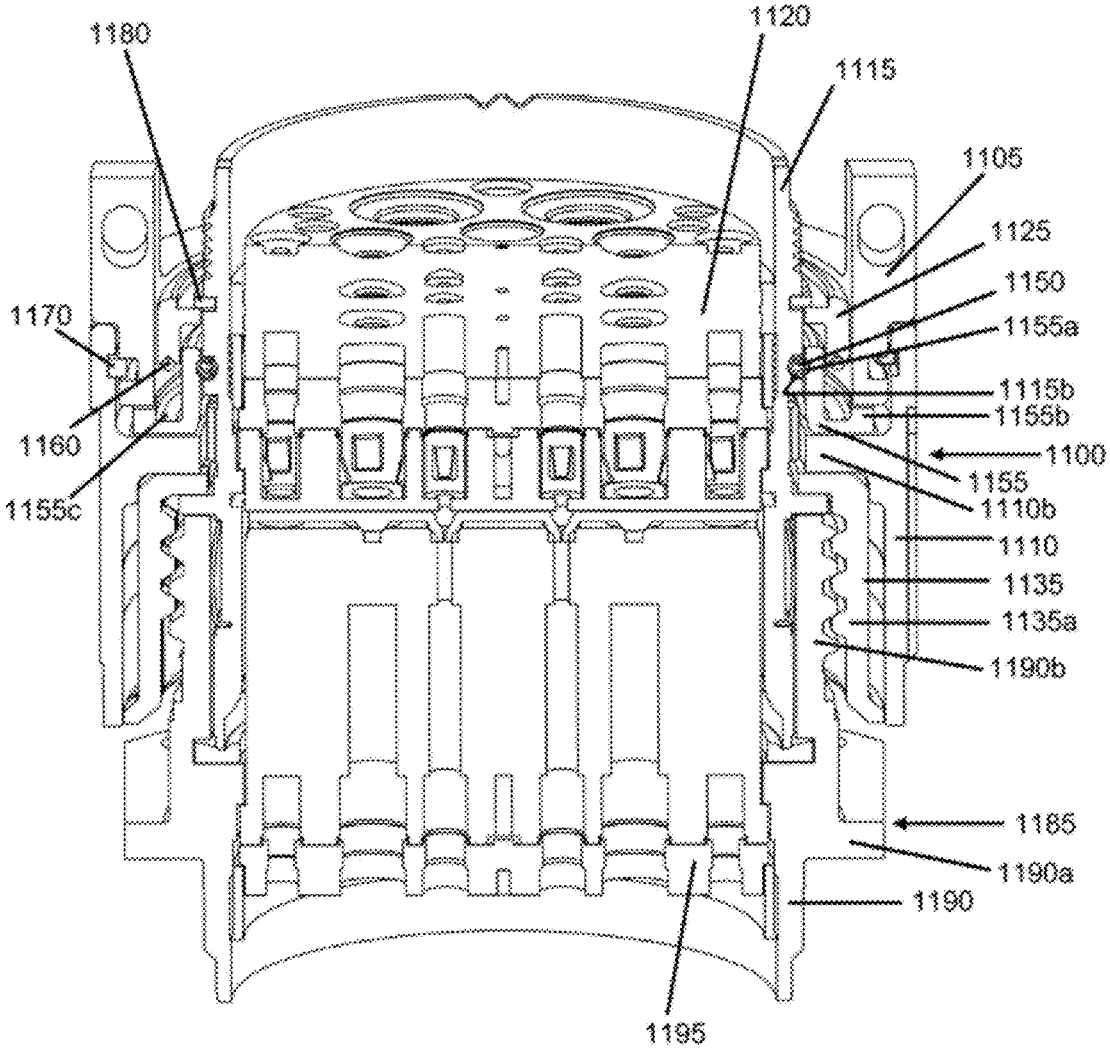
FIG. 11B is a side cross-sectional view of the lanyard connector and ordinance receptacle shown in FIG. 11A, in the mated position, according to an exemplary embodiment.

FIG. 11B is a side cross-sectional view of the lanyard connector 1100 and the ordinance receptacle 1185 in the mated position, according to an exemplary embodiment. The lanyard connector 1100 includes a plug insert assembly 1120 positioned within the plug housing 1115. Six threaded segments 1135 having a plurality of threads 1135*a* surround the plug housing 1115 and the ordinance receptacle 1185 via a plurality of threads 1190*b* on the receptacle housing 1190. The sleeve 1110 surrounds the plug housing 1115 and the threaded segments 1135 and prevents the threaded segments 1135 from expanding outward and releasing the ordinance receptacle 1185.

The connector 1100 also includes a canted coil latching spring 1150. The latching spring 1150 is disposed partially within a groove 1115*b* on the plug housing 1115. The latching spring 1150 also interfaces with a groove 1155*a* on a locking ring 1155. The locking ring 1155 includes a flange 1155*b* in contact with the lanyard ring 1105 and a protrusion 1110*b* extending from the interior of the sleeve 1110.

The connector 1100 also includes a reset spring 1160 positioned below the rear connector cover 1125 and at least partially within a groove 1155*c* of the locking ring 1155. The rear connector cover 1125 holds the reset spring 1160 in place.

The connector 1100 further includes a circular lanyard ring retainer 1170. The lanyard ring retainer 1170 holds the lanyard ring 1105 to the sleeve 1110 and allows the sleeve 1110 to rotate. The connector 1100 also includes a circular rear cover retainer 1180. The rear cover retainer 1180 is positioned around the plug housing 1115 and above the rear connector cover 1125. The rear cover retainer 1180 forces the rear connector cover 1125 towards the reset spring 1160, which ultimately holds the connector 1100 together.

The ordinance receptacle 1185 includes a receptacle insert assembly 1195 positioned inside the receptacle housing 1190. The receptacle insert assembly 1195 is configured to mate with the plug insert assembly 1120 via contact pins (not shown) when the lanyard connector 1100 is coupled to the ordinance receptacle 1185.

Figure 11C:
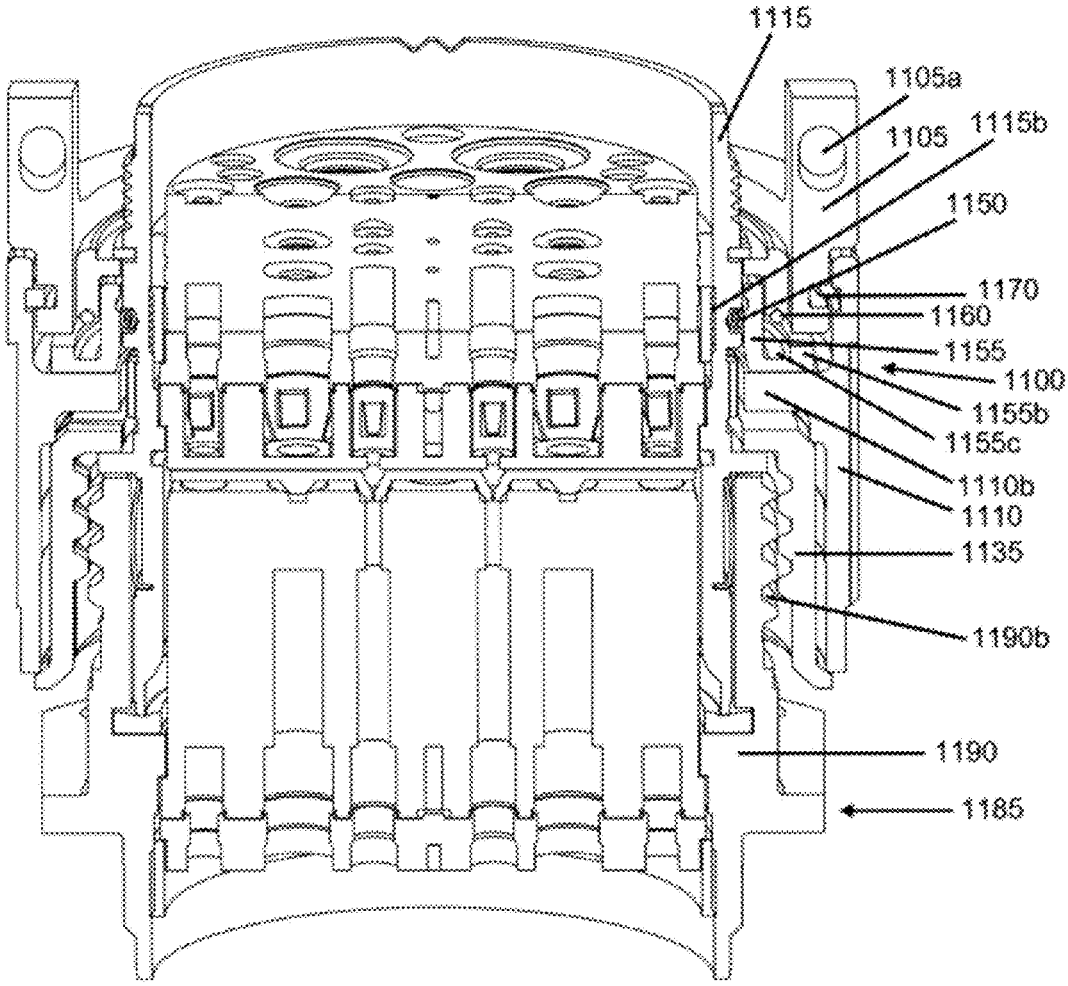
FIG. 11C is a side cross-sectional view of the lanyard connector and ordinance receptacle shown in FIG. 11A, in an actuated position, according to an exemplary embodiment.

FIG. 11C is a side cross-sectional view of the lanyard connector 1100 and ordinance receptacle 1185 in an actuated position, according to an exemplary embodiment. The lanyard ring 1105 is shifted upward by pulling on a lanyard cable (not shown) coupled to openings 1105*a* on the lanyard ring 1105. The lanyard ring 1105 is coupled to the sleeve 1110 by the lanyard ring retainer 1170. Upon actuation of the lanyard ring 1105, the sleeve 1110 shifts upward. As the sleeve 1110 shifts, the locking ring 1155 is also forced upwards by the flange 1155*b* resting on the protrusion 1100*b* of the sleeve 1110. As a result, the latching spring 1150 is then compressed and fully disposed with the groove 1115*b* on the plug housing 1115. Upon actuation, the reset spring 1160 also starts compressing between the groove 1155*c* of the locking ring 1155 and the rear connector cover 1125. As the sleeve 1110 shifts upward, the threaded segments 1135 begin moving outward and start disengaging from the threads 1190*b* on the receptacle housing 1190.

Figure 11D:
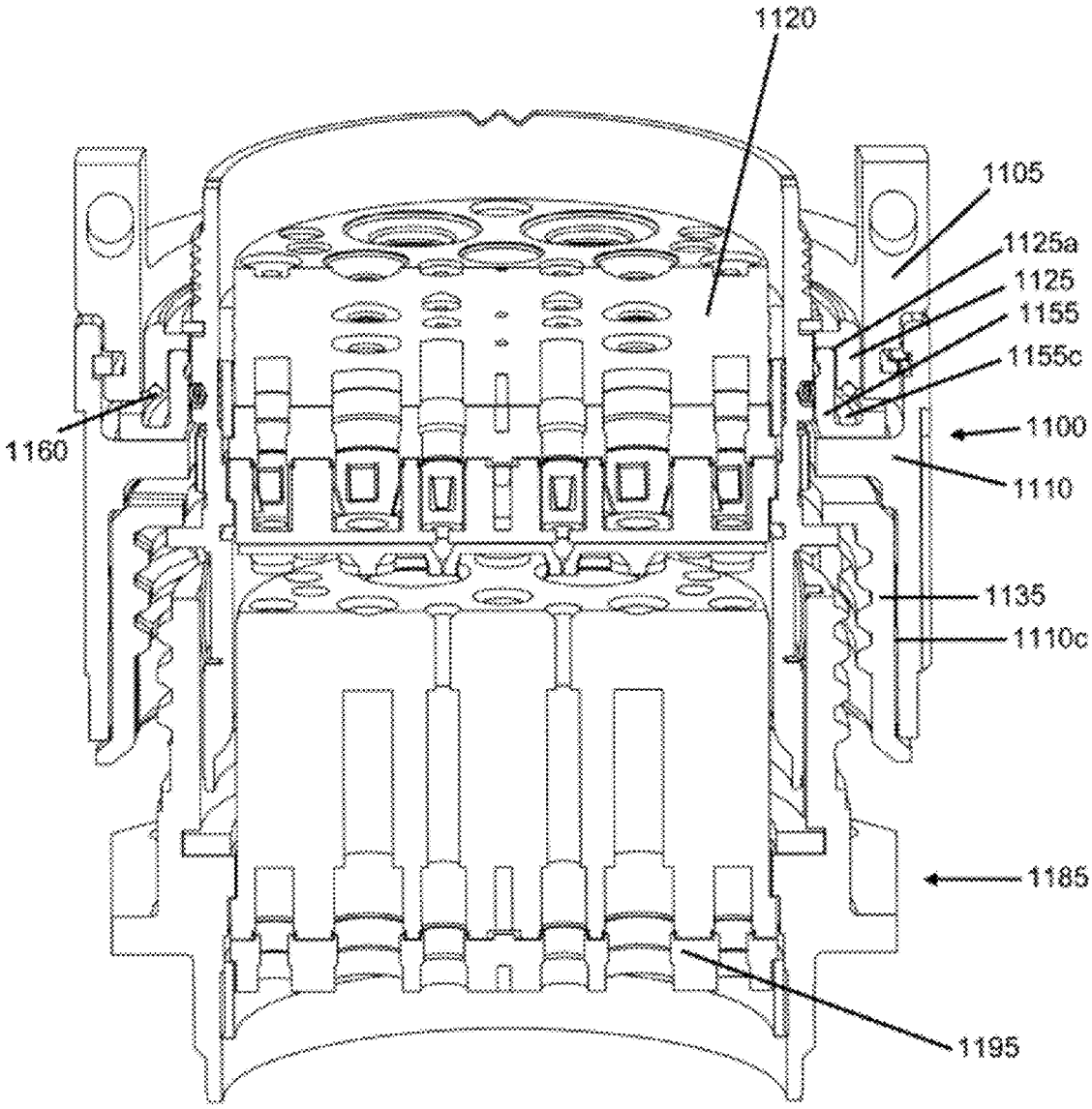
FIG. 11D is a side cross-sectional view of the lanyard connector and ordinance receptacle shown in FIG. 11A, in a released position, according to an exemplary embodiment.

FIG. 11D is a side cross-sectional view of the lanyard connector 1100 and ordinance receptacle 1185 in a released position, according to an exemplary embodiment. The sleeve 1110, the locking ring 1155, and the lanyard ring 1105 shift upward together until the locking ring 1155 abuts a surface 1125*a* of the rear cover 1125. In the released position, the reset spring 1160 is fully compressed between the groove 1155*c* of the locking ring 1155 and the rear connector cover 1125. The threaded segments 1135 are substantially separated from one another and rest against an interior 1110*c* of the sleeve 1110. Upon separation of the six threaded segments 1135 from each other, the threads 1135*a* disengage with the corresponding threads 1190*b* on the receptacle housing 1190, and allow disconnection of the plug insert assembly 1120 from the receptacle insert assembly 1195.

Figure 11E:
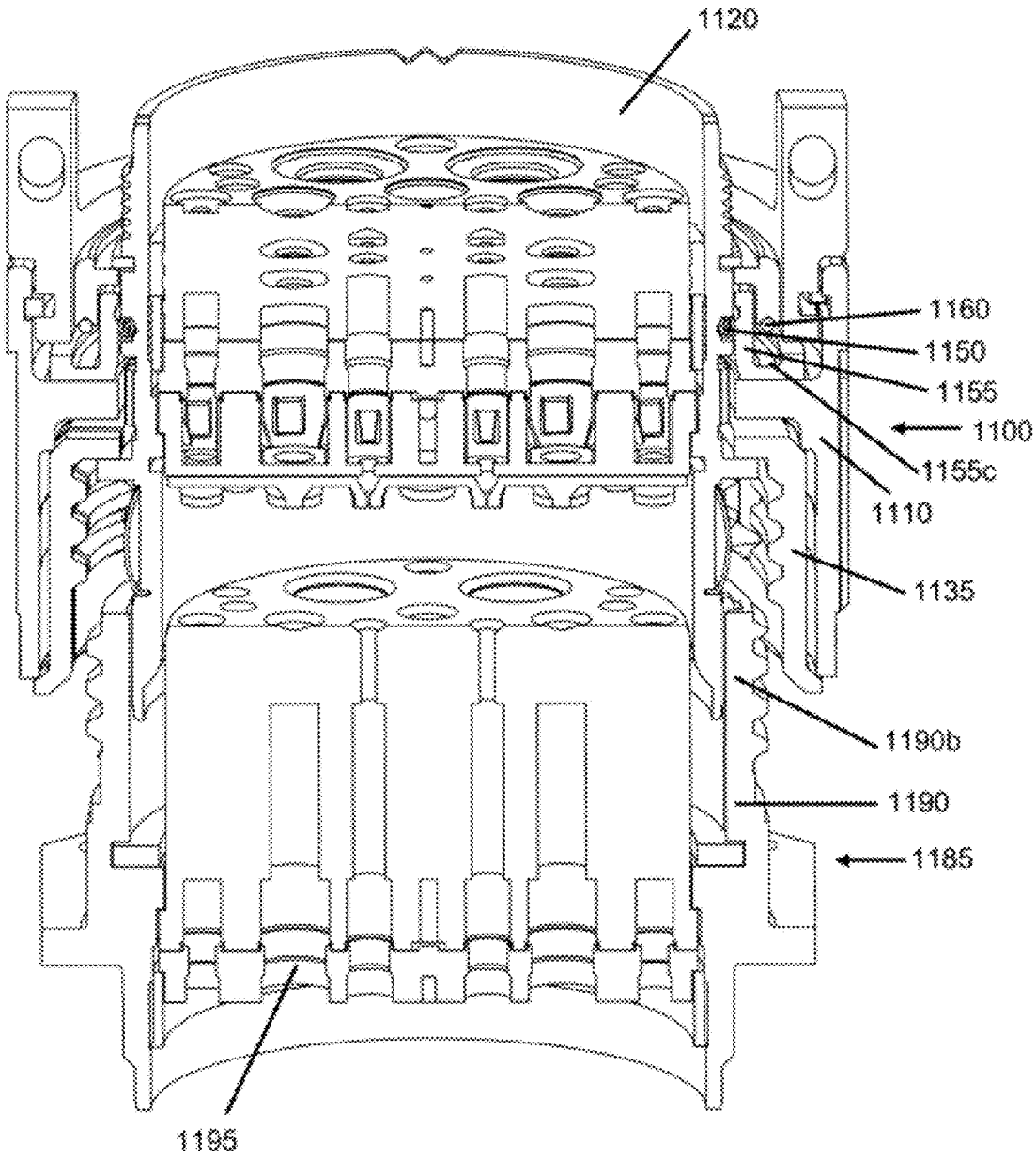
FIG. 11E is a side cross-sectional view of the lanyard connector and ordinance receptacle shown in FIG. 11A, in a cleared position, according to an exemplary embodiment.

FIG. 11E is a side cross-sectional view of the lanyard connector 1100 and ordinance receptacle 1185 in a cleared position, according to an exemplary embodiment. As the threads 1190*b* of the receptacle housing 1190 fully disengage from the threaded segments 1135, and the plug insert assembly 1120 is fully cleared of the receptacle insert assembly 1195, ordinance receptacle 1185 is separated and released from the lanyard connector 1100. The reset spring 1160 then pushes against the sliding force of the latching spring 1150 against the locking ring 1155 and forces the sleeve 1110 towards the mated position described with respect to FIG. 11B. The sleeve 1110 moves downward and shifts the threaded segments 1135 inward to their initial mated position, as described with respect to FIG. 11B.

Figure 11F:
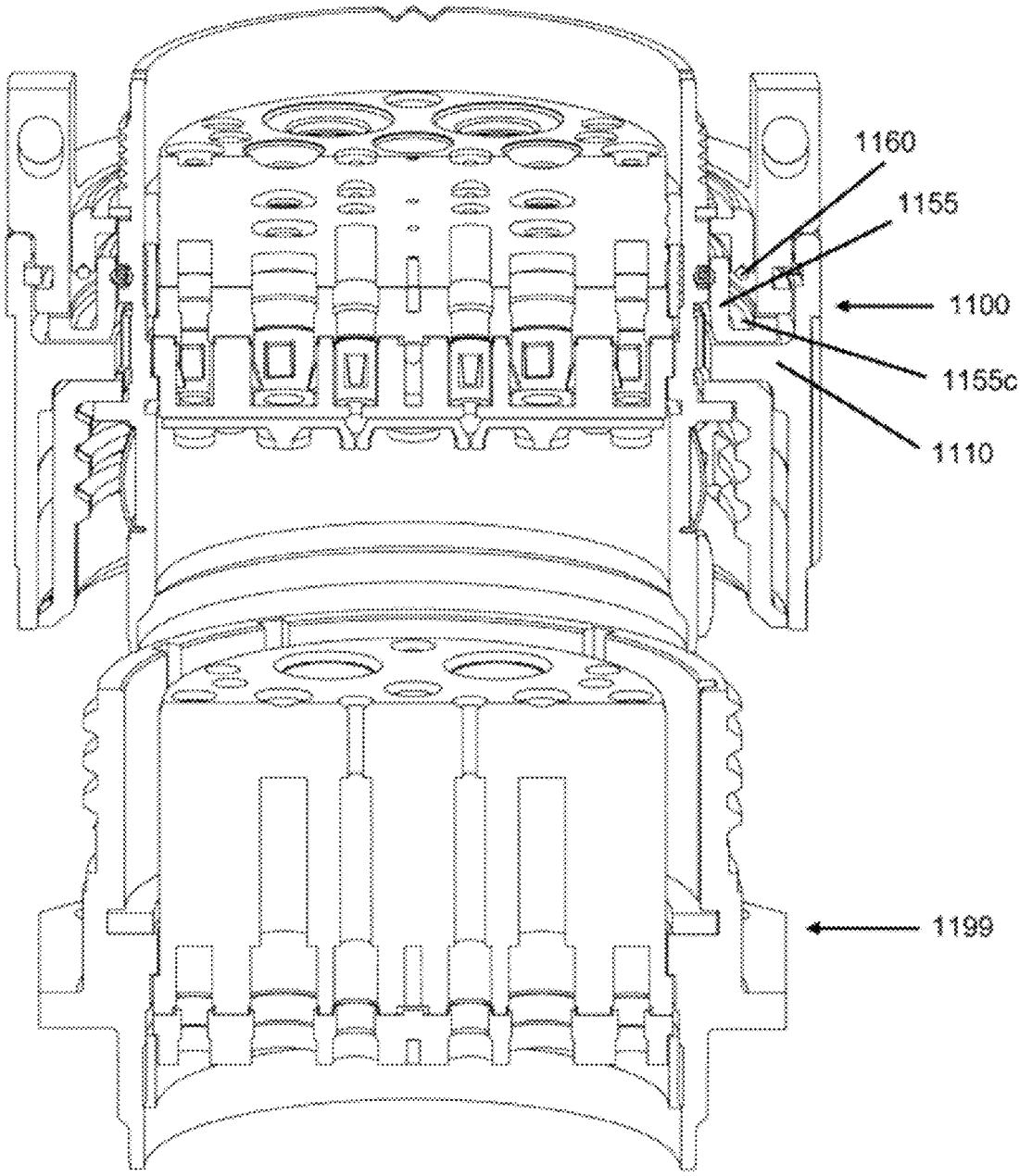
FIG. 11F is a side cross-sectional view of the lanyard connector and ordinance receptacle shown in FIG. 11A, in a reset position, according to an exemplary embodiment.

FIG. 11F is a side cross-sectional view of the lanyard connector 1100 and ordinance receptacle 1185, in a reset position, according to an exemplary embodiment. The reset spring 1160 has forced the sleeve 1110 to the mated position described with respect to FIG. 11B, by pushing down on the locking ring 1155 via groove 1155*c*. As a result, the remaining components shift to their respective mated positions, as described with respect to FIG. 11B. The lanyard connector 1100 can now be coupled to a receptacle 1199 for ordinance release.

Figure 12:
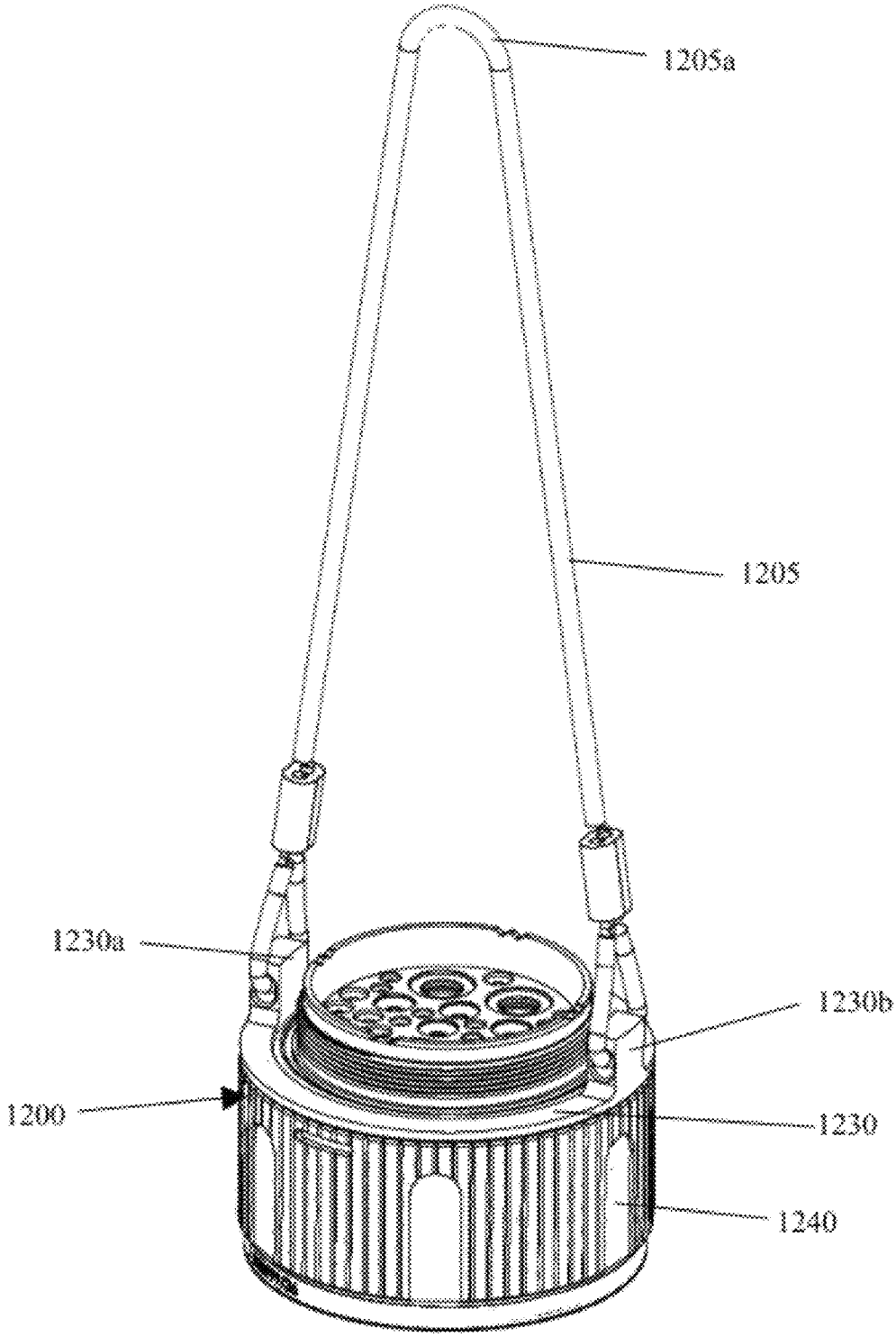
FIG. 12 is a perspective view of a lanyard connector coupled to a lanyard cable, according to an exemplary embodiment.

FIG. 12 is a perspective view of a lanyard connector 1200 coupled to a lanyard cable 1205, according to an exemplary embodiment. The lanyard cable 1205 may be coupled to a bail bar (not shown) via a loop 1205*a* in the lanyard cable 1205. The cable 1205 is coupled to a first end 1230*a* and a second end 1230*b* of a lanyard ring 1230. The lanyard ring 1230 is coupled to a coupling sleeve 1240. The connector 1200 is coupled to an ordinance (not shown) to be released. To release the ordinance, the ordinance pulls on the connector 1200 downward. The lanyard cable 1205 coupled to the bail bar prevents release of the connector 1200, and the connector 1200 is actuated by pulling the lanyard cable 1205 so as to shift the lanyard ring 1230 upwards. As described with respect to FIGS. 11B-11E, shifting the lanyard ring 1230, as well as the coupling sleeve 1240, upwards allows for the threaded segments (not shown) to separate more from one another. The increase in separation of the threaded segments from one another allows for disengagement of an ordinance receptacle (not shown) from the connector 1200. After release of the ordinance receptacle, another ordinance receptacle (not shown) can then be coupled to the connector 1200 by mating the receptacle with the threaded segments in the connector 1200 via corresponding threads on the receptacle and threaded segments.

Generally, the components of the lanyard connectors of the present invention may be fabricated from material suitable per military specifications. Suitable materials include, but are not limited to, aerospace-grade aluminum alloys, corrosion-resistant or stainless steel, and engineering-grade plastics. The lanyard connectors of the present invention are capable of handling the forces associated with the release of an ordinance without damaging the aircraft carrying the ordinance or the connectors themselves. The inclusion of a latching spring and a locking ring in the connectors decreases the forces necessary for the reset spring to move the components into their original mated positions. As a result, the likelihood of ratcheting occurring upon release of the ordinance receptacle is minimized.

Any spatial references herein, such as, for example, "top," "bottom," "upper," "lower," "above", "below," "rear," "between," "vertical," "angular," "beneath," etc., are for purpose of illustration only and do not limit the specific orientation or location of the described structure.

Therefore, the invention is well adapted to attain the ends and advantages mentioned as well as those that are inherent therein. The particular embodiments disclosed above are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit and scope of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention as defined by the claims below. The terms in the claims have their plain, ordinary meaning unless otherwise explicitly and clearly defined by the patentee.

What is claimed is:

1. A lanyard connector, comprising:

a coupling sleeve movable between a first position and a second position;

a locking ring configured to engage the coupling sleeve and movable between the first position and the second position, the locking ring having a first groove and a second groove;

a latching spring, wherein the latching spring is partially disposed within the first groove at the first position, and wherein the latching spring disengages the first groove at the second position;

a connector cover positioned proximate the locking ring; and a reset spring held in place by the connector cover, wherein a portion of the reset spring is disposed within the second groove, and wherein the lanyard connector is configured to couple to a lanyard cable and an ordinance receptacle.

2. The lanyard connector of claim 1, further comprising a lanyard ring coupled to the coupling sleeve and movable between the first position and the second position, wherein the lanyard ring is configured to couple to the cable.

3. The lanyard connector of claim 2, further comprising a lanyard ring retainer, wherein the lanyard ring retainer couples the lanyard ring to the coupling sleeve.

4. The lanyard connector of claim 1, further comprising a rear cover retainer, wherein the rear cover retainer forces the connector cover towards the reset spring.

5. The lanyard connector of claim 1, wherein the coupling sleeve further comprises a plurality of grooves configured to receive a plurality of corresponding anti-rotation mechanisms.

6. The lanyard connector of claim 5, further comprising a plurality of anti-rotation mechanisms positioned in the plurality of grooves.

7. The lanyard connector of claim 1, further comprising a plurality of threaded segments in communication with the coupling sleeve, wherein adjacent threaded segments are partially separated in the first position, and wherein the threaded segments are more separated in the second position.

8. The lanyard connector of claim 1, further comprising a plug housing having a third groove, wherein the latching spring is partially disposed within the third groove at the first position, and wherein the latching spring is fully disposed within the third groove at the second position.

9. The lanyard connector of claim 8, wherein the plug housing is coupled to the locking ring by a rear cover retainer.

10. The lanyard connector of claim 8, further comprising a plug insert assembly positioned within the plug housing.

11. The lanyard connector of claim 1, wherein the reset spring is a sinusoidal type spring.

12. The lanyard connector of claim 1, wherein the latching spring is a canted coil type spring.

13. A method of releasing an ordinance receptacle coupled to a lanyard connector, the method comprising:

coupling the receptacle to the lanyard connector, wherein the lanyard connector comprises:

a lanyard ring movable between a first position and a second position;

a coupling sleeve coupled to the lanyard ring and movable between the first position and the second position;

a locking ring configured to engage the coupling sleeve and movable between the first position and the second position, the locking ring having a first groove and a second groove;

a latching spring, wherein the latching spring is partially disposed within the first groove at the first position;

a connector cover positioned proximate the locking ring; and a reset spring held in place by the connector cover, wherein a portion of the reset spring is disposed within the second groove;

actuating the lanyard ring, coupling sleeve, and locking ring from the first position to the second position, wherein the latching spring disengages the first groove, and wherein the reset spring is compressed;

releasing the receptacle from the lanyard connector; and resetting the lanyard ring, coupling sleeve, and locking ring from the second position to the first position.

14. The method of claim 13, wherein the lanyard ring is coupled to a cable, and wherein the lanyard ring is actuated from the first position to the second position by pulling on the cable.

15. The method of claim 13, wherein the lanyard connector further comprises a plurality of threaded segments in communication with the coupling sleeve, wherein adjacent threaded segments are partially separated from each other, and coupled to the receptacle in the first position in the first position.

16. The method of claim 15, wherein the threaded segments are more separated in the second position, thereby releasing the receptacle.

17. The method of claim 13, wherein the lanyard connector further comprises a plug housing having a third groove, wherein the latching spring is partially disposed within the third groove at the first position.

18. The method of claim 13, wherein the lanyard connector further comprises a plug housing having a third groove, wherein the latching spring is fully compressed within the third groove at the second position.

19. The method of claim 13, wherein the reset spring is a sinusoidal type spring.

20. The method of claim 13, wherein the latching spring is a canted coil type spring.

21. A lanyard connector, comprising:

a means for connecting to a lanyard cable, movable between a first position and a second position;

a means for coupling a plurality of segments configured to engage a receptacle, wherein the coupling means is coupled to the lanyard cable connecting means, and is movable between the first position and the second position;

a locking means configured to engage the coupling means and movable between the first position and the second position, the locking means having a first receiving means and a second receiving means;

a latching mechanism, wherein the latching mechanism is partially disposed within the first receiving means at the first position, and wherein the latching mechanism disengages the first receiving means at the second position;

a cover positioned proximate the locking means; and a reset mechanism held in place by the cover, wherein a portion of the reset mechanism is disposed within the second receiving means, and wherein the reset mechanism is compressed at the second position.

* * * * *